US007546715B2

(12) United States Patent
Roen

(10) Patent No.: US 7,546,715 B2
(45) Date of Patent: Jun. 16, 2009

(54) STRUCTURALLY INTEGRATED ACCESSIBLE FLOOR SYSTEM

(76) Inventor: Roger C. Roen, N. 3510 Indian Bluff Rd., Spokane, WA (US) 99224

( * ) Notice: Subject to any disclaimer, the term of this patent is extended or adjusted under 35 U.S.C. 154(b) by 967 days.

(21) Appl. No.: 10/410,934

(22) Filed: Apr. 9, 2003

(65) Prior Publication Data

US 2003/0196402 A1 Oct. 23, 2003

Related U.S. Application Data

(63) Continuation-in-part of application No. 09/887,772, filed on Jun. 21, 2001, now abandoned.

(51) Int. Cl.
*E04B 5/00* (2006.01)
*E04B 5/43* (2006.01)

(52) U.S. Cl. ..... 52/506.05; 52/126.5; 52/384; 52/385; 52/506.07; 52/480

(58) Field of Classification Search ..... 52/177, 52/384, 385, 506.06, 506.07, 506.05, 263, 52/126.5, 22, 480
See application file for complete search history.

(56) References Cited

U.S. PATENT DOCUMENTS

| | | | | | |
|---|---|---|---|---|---|
| 776,419 | A | * | 11/1904 | Platt | 404/43 |
| 1,031,043 | A | * | 7/1912 | Conzelman | 52/252 |
| 1,576,482 | A | | 3/1926 | Lehn | |
| 1,818,299 | A | | 8/1931 | Bowman | |
| 1,940,968 | A | * | 12/1933 | Ohlis | 52/464 |
| 3,025,934 | A | * | 3/1962 | Spiselman et al. | 52/126.6 |
| 3,065,506 | A | * | 11/1962 | Tremer | 52/126.6 |
| 3,180,460 | A | | 4/1965 | Liskey, Jr. | 189/34 |
| 3,263,388 | A | * | 8/1966 | Bogert | 52/665 |
| 3,396,501 | A | | 8/1968 | Tate | 52/173 |
| 3,516,347 | A | | 6/1970 | May | 98/31 |
| 3,583,121 | A | | 6/1971 | Tate et al. | 52/481 |
| 3,685,235 | A | | 8/1972 | Lang | 52/39 |
| 3,924,370 | A | | 12/1975 | Cauceglia et al. | 52/126 |
| 4,348,841 | A | | 9/1982 | Ueno et al. | 52/126.5 |
| 4,593,509 | A | | 6/1986 | Linton | 52/262 |
| 4,628,645 | A | * | 12/1986 | Tafelski, Jr. | 52/169.1 |
| 4,630,417 | A | | 12/1986 | Collier | 52/263 |
| 4,676,036 | A | | 6/1987 | Bessert | 52/126.6 |
| 4,682,453 | A | * | 7/1987 | Holmgren | 52/126.2 |
| 4,841,709 | A | * | 6/1989 | Peterson et al. | 52/664 |
| 4,922,670 | A | * | 5/1990 | Naka et al. | 52/126.6 |
| 4,999,964 | A | * | 3/1991 | Taylor | 52/477 |
| 5,049,700 | A | * | 9/1991 | Kobayashi et al. | 174/48 |
| 5,079,890 | A | * | 1/1992 | Kubik et al. | 52/649.1 |
| 5,187,907 | A | | 2/1993 | Takeda et al. | 52/221 |

(Continued)

FOREIGN PATENT DOCUMENTS

WO WO 03/000013 A2 1/2003

*Primary Examiner*—Sarah B McPartlin
(74) *Attorney, Agent, or Firm*—Seed IP Law Group PLLC

(57) ABSTRACT

A floor system for a building that includes primary and secondary structural supports, a grid attached to the supports, and a plurality of panels removably mounted in the grid to provide access to the space below the panels and the grid. The floor system replaces conventional permanent structural floors, and provides ready access to the underlying space, which would otherwise be inaccessible in a conventional floor.

23 Claims, 10 Drawing Sheets

U.S. PATENT DOCUMENTS 5,323,575 A * 6/1994 Yeh ..... 52/177
5,341,614 A 8/1994 Shimizu ..... 52/220.1
5,412,914 A 5/1995 Daw et al. ..... 52/126.6
5,477,649 A * 12/1995 Bessert ..... 52/263
5,715,636 A * 2/1998 Taylor ..... 52/308
5,787,663 A * 8/1998 Wehrmann ..... 52/263
5,806,270 A 9/1998 Solano et al. ..... 52/747.11
5,885,154 A 3/1999 Napadow et al. ..... 454/301
5,953,870 A * 9/1999 Jette ..... 52/220.1
5,979,134 A * 11/1999 Neff ..... 52/506.07
5,983,582 A 11/1999 Vugrek ..... 52/263
5,992,111 A * 11/1999 Waterhouse ..... 52/308
6,044,610 A 4/2000 DeVon et al. ..... 52/653.1
6,550,195 B1 * 4/2003 Cooper et al. ..... 52/220.3
6,637,161 B1 * 10/2003 Buchalter et al. ..... 52/126.6
6,694,691 B2 * 2/2004 Ku ..... 52/403.1
6,755,001 B2 * 6/2004 Eaton ..... 52/506.06
2002/0003194 A1 * 1/2002 Simmons ..... 248/49
2003/0192268 A1 * 10/2003 Zaborowski ..... 52/220.6

* cited by examiner

STRUCTURALLY INTEGRATED ACCESSIBLE FLOOR SYSTEM

CROSS-REFERENCE TO RELATED APPLICATION

This application is a continuation-in-part of U.S. patent application Ser. No. 09/887,772, filed Jun. 21, 2001, now pending, which application is incorporated herein by reference in its entirety.

BACKGROUND OF THE INVENTION

1. Field of the Invention

The present invention relates to floor structures, and more specifically to a floor assembly having removable access panels supported on a grid that is supported on a plurality of primary and secondary structural supports.

2. Description of the Related Art

The increase in the use of computers, communication devices, and other electronic hardware has placed new demands on building designers. Users desire a large number of outlets for access to electrical power and communication signals, and they need the ability to change the location of such outlets on a regular, sometimes frequent basis. Power and data outlets have been located in, or under, a floor, typically in removable floor sections elevated above the original floor by supports. Two typical types of elevated floors are the pedestal floor and the low-profile floor.

The pedestal access floor has pedestals that consist of metal rods with a base plate at one end and a supporting plate on the other that supports removable horizontal panels, thus forming a raised floor structure. The metal rods are height adjustable and rest on a conventional solid floor deck. The solid floor deck may be made of wood, concrete, or a combination of metal deck and a deck may be made of wood, concrete, or a combination of metal deck and a concrete topping slab. The rods are arranged in a grid, typically square. The rods and plates support removable floor sections. The height of the rods is typically about 12 to 18 inches and can be adjusted to a desired height prior to installing the floor sections. Electrical power and data cables are laid between the solid floor deck and the underside of the floor sections. The cables penetrate the floor sections at a desired location to suit the user's needs. The penetrations may consist only of openings for cables, or may be junction boxes, similar to common electrical wall outlets. The penetrations may accommodate power wires, or signal cables such as cable television, speaker wire, computer networks, etc. In some designs, the space between the floor deck and the elevated floor sections is configured to enable the distribution of conditioned air through grilles and/or registers located in selected floor sections. A flooring system of the type described above is disclosed in U.S. Pat. No. 3,396,501, issued to D. L. Tate on Aug. 13, 1968.

There is a labor premium involved in having to locate and install the foregoing pedestal system. The pedestals must be braced to meet seismic code, further increasing labor and cost. Moreover, the pedestals increase ceiling height requirements, and ultimately the height of the building, which increases the area of the exterior envelope, thereby increasing not only construction costs but also operating costs due to heat loss. If the pedestal access floor is only used in parts of a building, ramps or structural accommodations must be made for the changes in floor elevation. As users re-route electrical cables below the access floor, the pedestals may present an impediment in pulling cables to a new location. The access floor also represents another step in the construction schedule. The acoustical properties of this system are poor. The floor sections are usually relatively thin and rigid and transmit sound both horizontally and vertically.

A second type of elevated floor is a low-profile design, which may be roughly 2½ inches to 4 inches high. This design does not use pedestals to raise and support the floor sections, but rather relies on "feet" at the corners of the sections to create the space above the solid floor deck and below the underside of the panel. The panels, with low "feet," rest directly on the floor deck. This low-profile design is less costly than the pedestal floor, but still impacts the cost of a traditionally designed floor in a building because it requires the use of a solid floor deck. The problem of elevation changes between the existing conventional floor and accessible floor also remains.

There are also disadvantages to the low-profile floor compared to the pedestal floor. The space below the low-profile sections is not deep enough to be used to supply air. The resulting floor is not as stable, in either the horizontal or vertical dimension, as the pedestal access floor described above. Since the sections are not fastened to the floor deck, they can move when cable is being pulled and re-routed. It also increases the floor-to-floor height of the building, and thus the construction and operating costs. In general, the smaller distance between the solid floor deck and the surface of the floor sections decreases the flexibility of the low-profile floor. Both types require an underlying solid floor deck for support and to provide structural stability to the exterior building.

In addition, the acoustical characteristics of both common types of elevated floors are typically very poor. They tend to transmit noise to a degree that makes them impractical for use in many environments.

Another type of accessible floor is disclosed in U.S. Pat. No. 3,583,121, issued to D. L. Tate on Jun. 8, 1971. This system includes two layers of bar joists laid one on top of the other at right angles thereto. Panels laid over the upper layer may be configured to be removable, to provide access to space underneath. One disadvantage of this system is the height of the two layers of joists and the added height this imparts to a building. Additionally, the joists must be laid at least as closely together as the width of the panels. The resulting weight and depth of the system is too great to be practical except where particularly heavy loads are imposed on the floor. Also, the joists have to be welded at each intersection greatly increasing field labor costs.

BRIEF SUMMARY OF THE INVENTION

In accordance with one embodiment of the invention, a floor assembly for a building is provided, the floor assembly having a plurality of primary structural building members, a plurality of spaced-apart secondary structural building members spanning the primary building members, a support grid on the top surfaces of the secondary building members, and a plurality of panels mounted on the support grid to form the floor, with each of the panels individually removable from the support grid to provide access to the space beneath.

According to an alternative embodiment of the invention, a floor assembly is provided that includes a plurality of longitudinal structural supports, a grid assembly, an attachment system attaching the grid assembly to the upper surface of each of the longitudinal structural supports and configured to enable adjustment in the position of the grid assembly relative to the longitudinal structural supports, and a plurality of panels, the bottom portion of the panels configured to be received into openings in the grid, and the top portion configured to bear against a top surface of the grid assembly.

According to another embodiment of the invention, a floor system is provided, that includes a prefabricated floor section. The floor section comprises a plurality of support rails positioned a selected distance apart, each having a pair of spaced apart angle members with spacers positioned between the angle members. The support rails are configured to extend between two secondary structural members of a building. The floor section also includes a plurality of cross rails, each spanning between adjacent pairs of support rails, the support rails and cross rails together defining, between adjacent pairs of support rails and adjacent pairs of cross rails, a plurality of apertures, with each aperture configured to receive a removable floor panel.

In accordance with another embodiment of the invention, a building is provided that includes a plurality of primary structural building members, a plurality of spaced-apart secondary structural building members spanning the primary building members, a support grid affixed to the top surfaces of the secondary building members and configured to receive panels, an attachment system attaching the support grid to the top surface of each of the secondary structural building members and configured to enable adjustment in the position of the support grid relative to the secondary structural building members, and a plurality of panels received in the support grid to form a floor, each of the panels individually detachable from the support grid to provide access to the space between the secondary structural building members.

BRIEF DESCRIPTION OF THE SEVERAL VIEWS OF THE DRAWING(S)

DETAILED DESCRIPTION OF THE INVENTION

Figure 1:
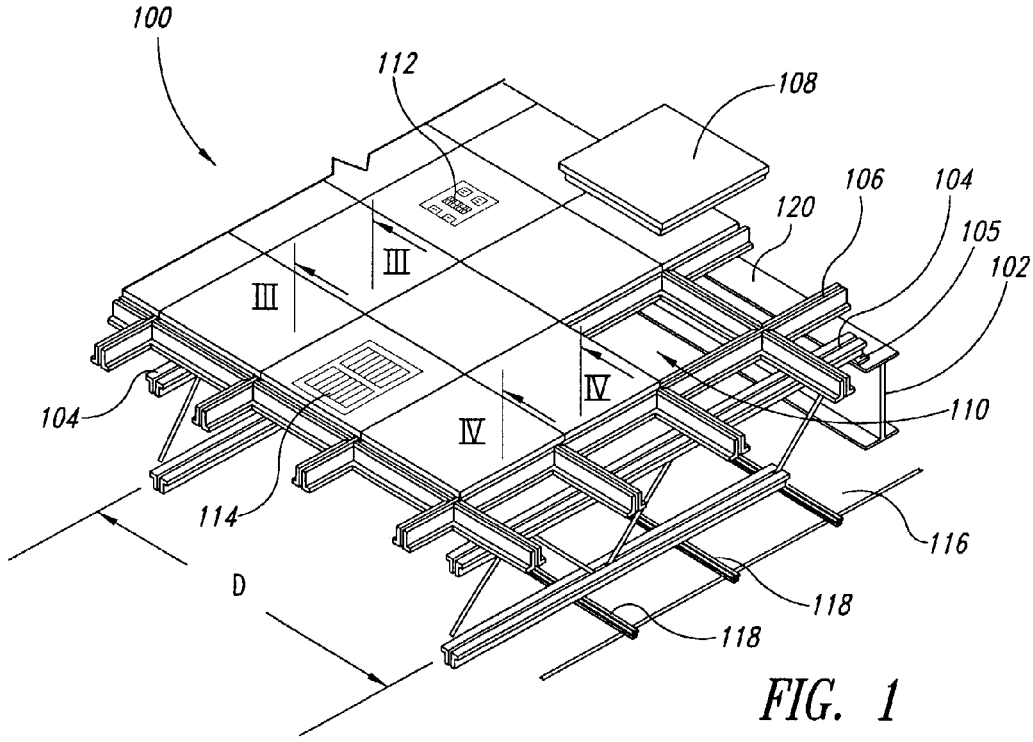
FIG. 1 shows an isometric view of a section of the floor system formed in accordance with one embodiment of the present invention.

The structurally integrated accessible floor system, hereinafter referred to as the floor system, is designated generally as 100, and is shown isometrically in FIG. 1.

Primary framing members 102 are provided, which can be formed as integral parts of metal frame type buildings. Secondary framing members, such as joists 104 are connected to the primary framing members 102. According to one embodiment of the invention, a structural support grid 106 is then formed bearing on the secondary framing members 104. The grid 106 is configured to receive removable floor panels 108 in the openings 110 formed by the grid 106.

The grid 106 is configured to span across the secondary framing members 104 such that a plurality of floor panels 108 are supported by the grid between each secondary framing member 104, without the need for support by a secondary framing member for each floor panel 108. For example, the grid 106 is shown in FIG. 1 spanning across a distance D between two secondary framing members 104 while supporting the width of three panels 108 in that same distance. This is in contrast to conventional removable flooring systems, in which each removable panel is generally supported by a grid having a leg, post, or pedestal at each corner of each panel.

The removable floor panels 108 are of a uniform size to allow interchangeability, and they may be provided with terminals or hookups 112 for electrical power and communication access, and with vents or registers 114 for ventilation.

For the sake of convenience and clarity, one type of power terminal 112 is shown in FIG. 1. However, it will be obvious to those skilled in the art that a wide variety of terminals may be used, including standard 110 volt sockets, coaxial cable terminals, fiber optical connections, heavy duty power terminals, T2 connectors, etc. A user may further choose to provide an opening in the panel to enable the passage of cable without the use of a terminal. These and other options are considered to be within the scope of the invention.

By the same token, a wide variety of means to transmit air and gas may be used in place of the vent 114, including compressed air hookups, vacuum lines, fans, directionally adjustable vents, filters, emergency gas evacuation systems, compressed oxygen, $CO_2$, propane, nitrogen, etc.

FIG. 1 also shows optional panels 116 attached to metal channels 118, which are in turn affixed to the underside of the secondary framing members. These panels 116 are ideally constructed of material that resists fire, thus forming a fire block. The panels 116 isolate one story of a building from the next, establishing fire protection, which may be required by many building codes. The panels 116 attached to the underside of the secondary framing members enclose the space between the secondary framing members. This enclosed space may be employed as a plenum for HVAC. This can result in a financial savings, because ductwork is reduced or eliminated. Partitions may be used within this space to permit discreet sections of the floor system to pressurize for use as a plenum.

Figure 2:
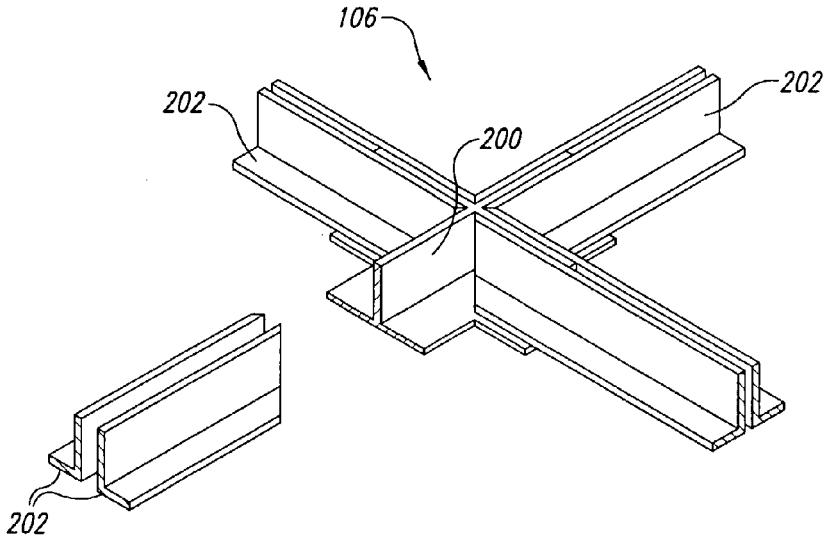
FIG. 2 shows a detail of a structural support grid element of a floor system formed in accordance with another embodiment of the present invention.

Referring next to FIG. 2, shown therein is a section of one embodiment of the structural support grid 106. According to this embodiment, the structural support grid comprises L-shaped rail members 202 affixed in back-to-back relationship to T-shaped joint nodes 200 to form supports for the removable floor panels. The nodes and rail members are standardized to permit interchangeability.

It is to be understood that the rail members may have many different cross-sectional shapes and node configurations. For example, some alternative cross-sectional shapes include channel, "T", and square.

Figure 3:
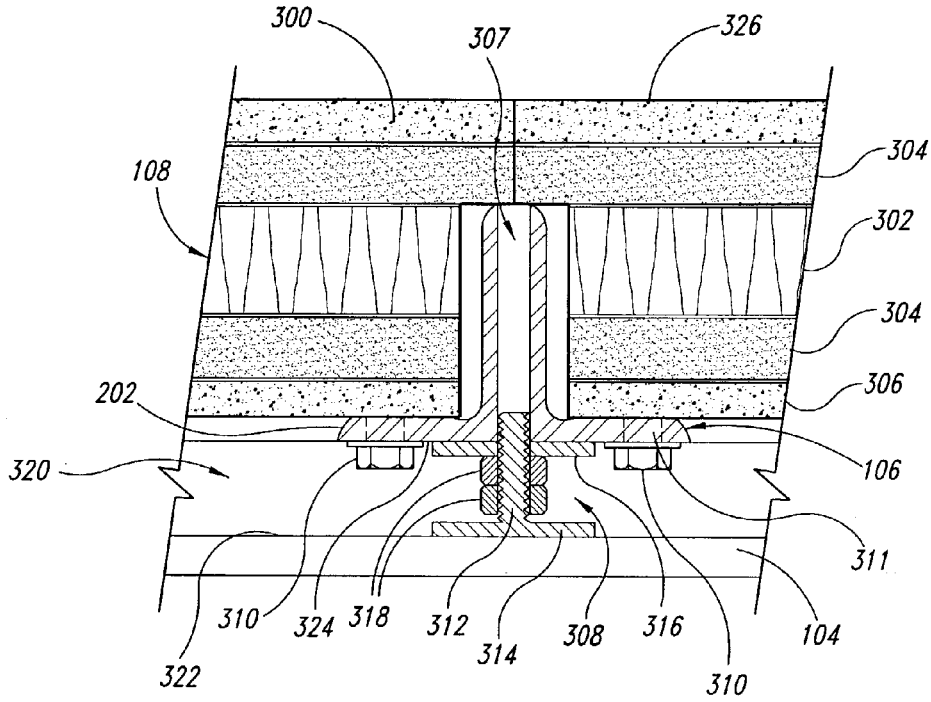
FIG. 3 is a cross-sectional view taken along line III-III of a portion of the floor system of FIG. 1.

FIG. 3 shows the floor system 100 in cross-section taken along lines III-III in FIG. 1. The removable floor panel 108 has a plurality of layers, including a top layer 300, which is configured according to the requirements of the particular application and may have a carpeted surface or a tile surface. Alternatively, the top surface 326 may be formed using chemically resistive materials for use in a lab or other caustic environments. The top layer 300 and a bottom layer 306 are designed to provide structural stiffness to the panel 108 and are configured according to the structural and weight bearing requirements of the particular application. Fire retardant layers 304 may also be structural and are composed of fire resistant materials such as gypsum, or other appropriate material, and serve to inhibit the passage of fire from one side of the panel 108 to the other. An insulation layer 302 provides thermal and acoustic insulation, and may be slightly oversized to provide a friction fit in the grid.

It will be understood that the composition of the removable floor panels will vary according to the requirements of a particular application and will in part be dictated by the anticipated environment, the required load carrying capacity, the desired appearance, the anticipated degree of noise control, local building and fire codes, and other factors.

Although the removable floor panels 108 bear against the structural support grid 106, panel fasteners 310 may be used to positively attach the panels 108 to the structural support grid 106. In the embodiment shown in FIG. 3, the panel fasteners 310 comprise threaded fasteners that pass from a lower surface of the structural support grid 106 into an opening in a lower surface of the removable panel 108 via an opening 311 in the rail member 202 of the structural support grid 106. The opening 311 is oversized in relation to the threaded fastener 310 to enable adjustment in the position of the removable panel 108 relative to the structural support grid 106. The threads of the threaded fastener 310 engage the removable panel and a hexagonal head of the fastener 310 bears against the lower surface 324 of the support grid 106, drawing the removable panel tight against the structural support grid 106. Thus, in this embodiment access to the panel fasteners 310 is from beneath the structural support grid 106.

A leveling unit 308 is provided to control a vertical distance 320 between the structural support grid 106 and the secondary framing members 104. FIG. 3 shows one of a plurality of similar units that comprise the leveling system, which functions as described below.

As shown in FIG. 3, the leveling unit 308 includes a threaded rod 312 attached to a support plate 314 that bears against an upper surface 322 of the secondary framing member 104. The threaded rod 312 passes through a lift plate 316 via an opening in the lift plate 316, with the lift plate 316 bearing upward against the lower surface 324 of the structural support grid 106. The rod 312 is slideably received in an opening 307 formed in the grid 106. A pair of jam nuts 318 on the threaded rod supports the lift plate 316. The position of the jam nuts 318 on the threaded rod determines the distance 320 between the upper surface 322 of the secondary framing member 104 and the lower surface 324 of the structural support grid 106.

By adjusting each of the plurality of units of the leveling system, the bearing surface 326 of the floor system 100 can be leveled, even if the upper surfaces 322 of the secondary framing members are not level.

In another embodiment of the invention, leveling devices that are functionally similar to the leveling unit 308 described above may be employed between an upper surface 120 (shown in FIG. 1) of the primary framing members 102 and the part 105 of the secondary framing members 104 that bears against the primary framing members. By adjusting the vertical distance between the primary and secondary framing members, the level of the structural support grid 106 can be controlled.

Other methods of controlling the vertical distance (not shown) between the primary and secondary framing members 102, 104, or between the structural support grid 106 and the secondary framing members 104 will be obvious to those skilled in the art. These methods include the use of wedges, shims, threaded devices that are accessed from above the floor system, automatic or remotely adjustable devices, etc., all of which are deemed to be within the scope of the invention.

Figure 4:
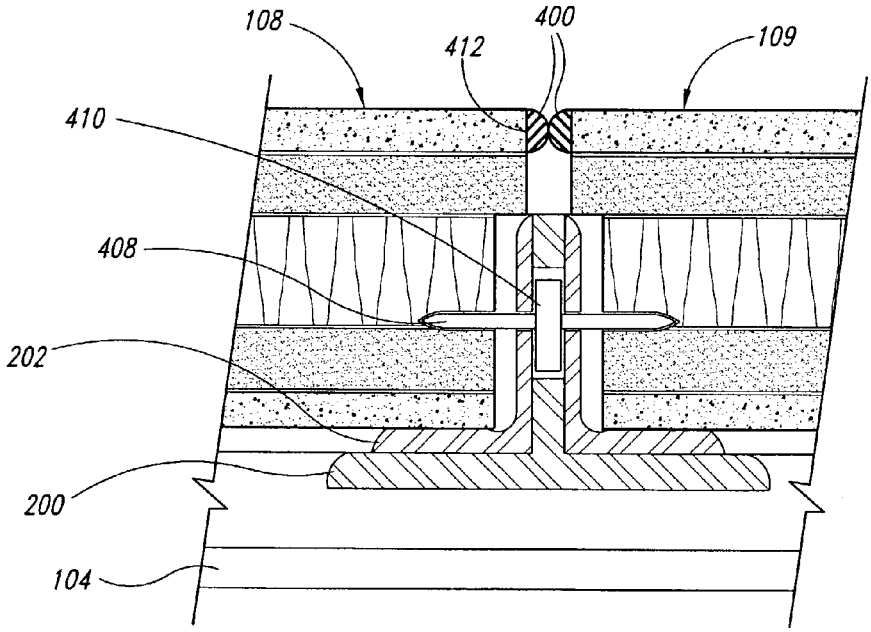
FIG. 4 is a cross-sectional illustration of an alternative embodiment of the floor system of FIG. 3 taken along line IV-IV.

FIG. 4 is a cross-sectional view of a floor system 100, taken along line IV-IV, and shows an alternative embodiment of the removable panel 108. In this embodiment, a flexible gasket 400 is affixed to the top edge 412 of each panel 108, 109. The gaskets 400 of adjoining panels 108, 109 press against each other, providing a seal between the removable panels 108, 109. The seal may be employed to prevent spills from leaking through the floor system. In applications where spills of caustic or dangerous fluids might be anticipated, the composition of the gasket 400 is chosen to be resistant to the particular classes of substances in use. Multiple or interlocking gaskets may also be employed to provide a more secure seal. Alternatively, a single gasket may be wedged between the adjoining panels 108, 109 after they are installed on the structural support grid 106. The gasket 400 may also be used in applications where it is desirable to control the movement of air or other gasses from one side of the floor system to the other.

FIG. 4 also shows an alternative embodiment of the panel fasteners. Here, the panel fastener 410 is accessed with a tool (not shown) that is inserted from above the surface of the floor system into the center of the joint node 200. The panel fastener 410 is rotated approximately 45°. Fastener blades 408 rotate from positions in slots (not shown) in the joint node 200 into slots in the corners of the removable panels 406, locking them in place.

Other locking devices and systems will be evident to those skilled in the art and are considered to be within the scope of the invention. Such devices include those employing cam-type fasteners, devices that are accessible from the surface of the removable floor panels, devices that latch automatically when the removable floor panels are emplaced, etc.

Depending upon the height and local requirements, some buildings include devices or methods of construction that provide earthquake resistance. In conventional construction methods a solid floor deck functions as a diaphragm, which is resistant to dimensional stresses.

Figure 5:
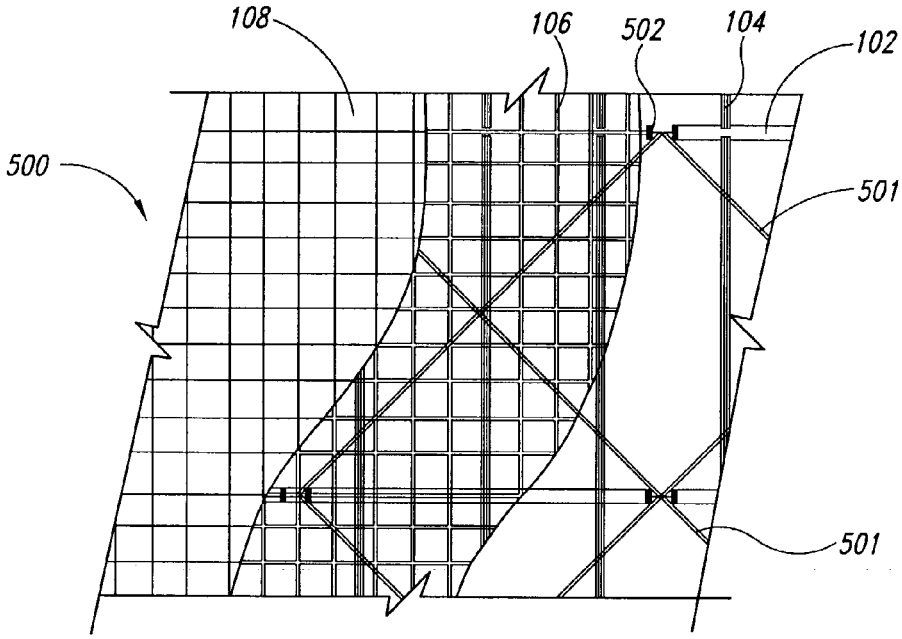
FIG. 5 is a plan view of a floor system according to another embodiment of the invention.

According to one embodiment of the invention, and as illustrated in FIG. 5, the structural support grid 106 is attached orthogonally, relative to the primary 102 and secondary 104 framing members. Diagonal stays 501 are employed to brace and provide the requisite stability to the structure. The stays 500 are attached directly to the primary columns 502 of a building and pass underneath the floor structure 500.

Figure 6:
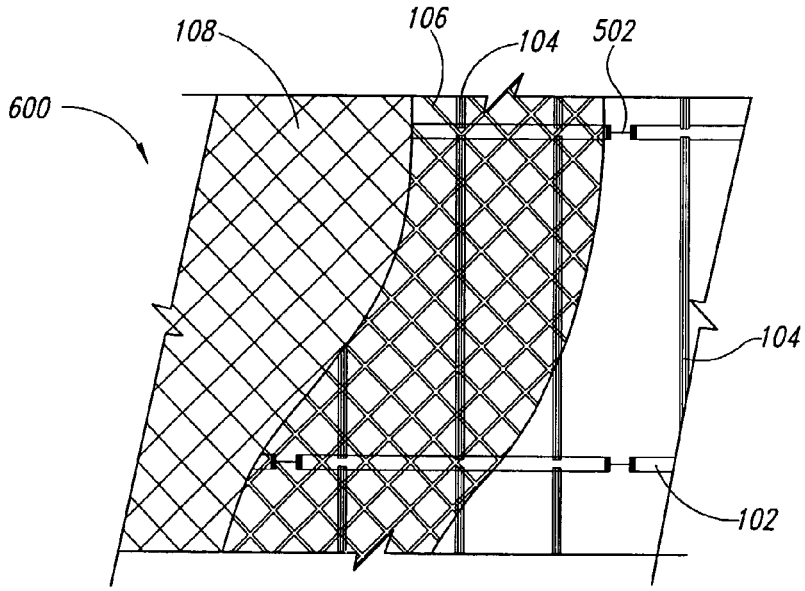
FIG. 6 is a plan view of a floor system according to an alternative embodiment of the invention.

FIG. 6 shows floor structure 600 according to an alternative embodiment of the invention, in which the structural support grid 106 is oriented diagonally, relative to the primary 102 and secondary 104 framing members. In this embodiment, the structural support grid 106 itself forms the diagonal bracing that reinforces the building structure.

Figure 7:
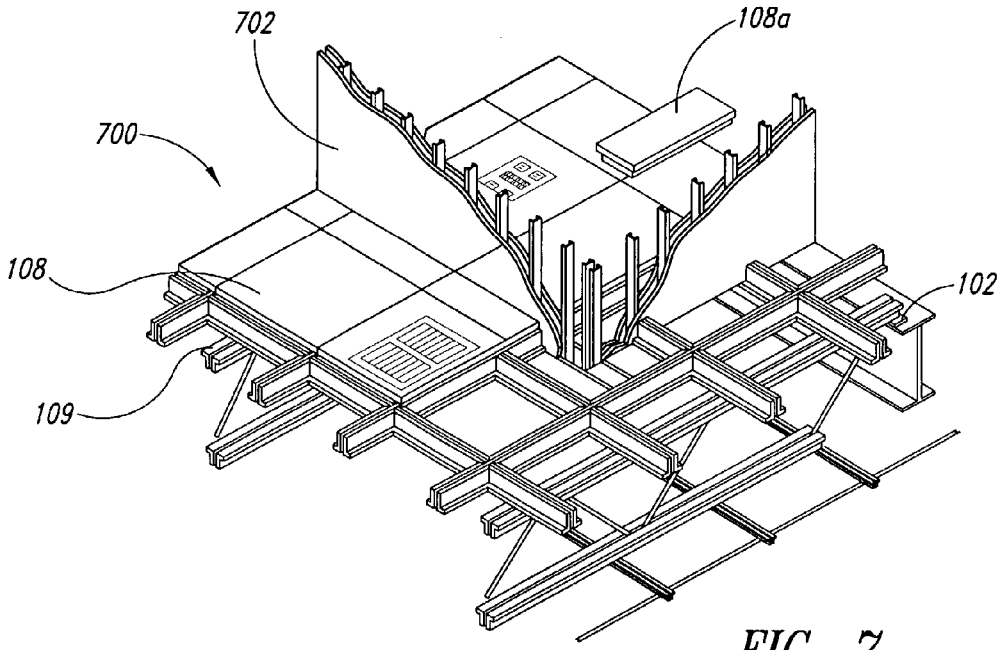
FIG. 7 is an isometric view of a further embodiment of a floor system of the present invention.

In a further embodiment of the invention, and as shown in FIG. 7, repositionable walls 702 may be employed as part of the structurally integrated accessible floor system 700. These repositionable walls may consist of floor to ceiling room dividers, which may be assembled on site, as shown in FIG. 7, or prefabricated and installed as individual units, or alternatively they may be prefabricated cubicle dividers of the type common in office environments. The repositionable walls 702 are affixed directly to the structural support grid 104. Partial floor panels 108*a* may be cut to the necessary size at the site, using conventional methods, or may be manufactured in common dimensions. By affixing the walls 702 to the grid 106 and employing partial floor panels, acoustical isolation is enhanced and the structural stability of the walls 702 is improved.

Electrical components in the walls 702, such as light switches, thermostats, power connections etc, may be wired directly through the bottom of the walls via harnesses (not shown) that can be connected to cables and connectors underneath the floor panels 108. This is a significant advantage, especially in the case of cubicle dividers, over the methods currently in use, because conventional cubicle dividers must bring power into open areas and may involve complex interconnections between the dividers, and power drops from ceilings. Other methods include the use of wireless technology for switches and controls. Such technology has the advantage that it doesn't require any wiring connections in the walls.

Figure 8:
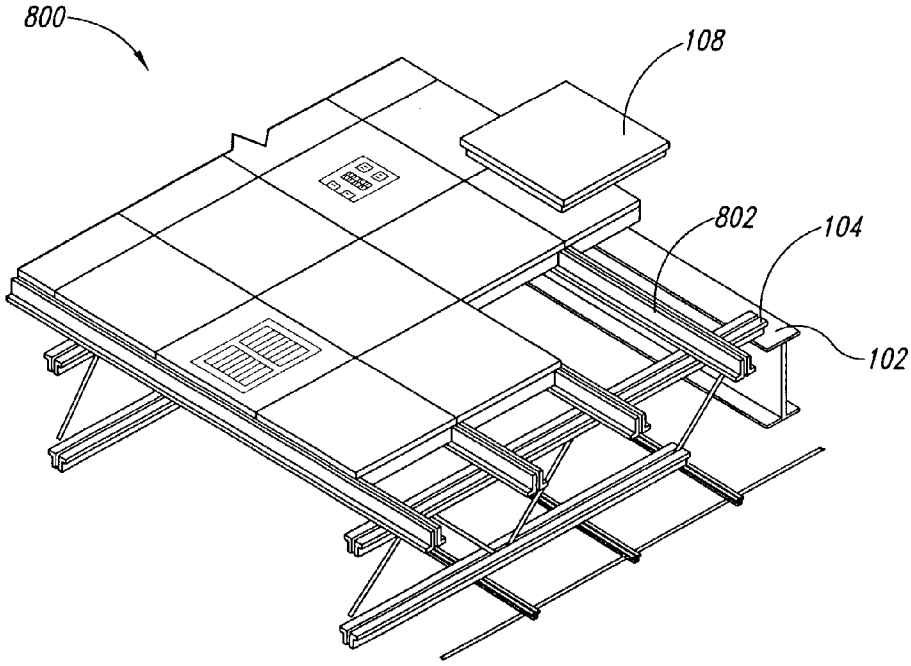
FIG. 8 is an isometric view of a floor system illustrating an alternative embodiment of the present invention.

FIG. 8 illustrates an alternative embodiment 800 of the invention in which structural support rails 802 are employed. The rails 802 span the secondary framing members 104 and support the removable floor panels 108 on two sides. The floor panels 108 of this embodiment are configured to span the structural support rails 802.

Figure 9:
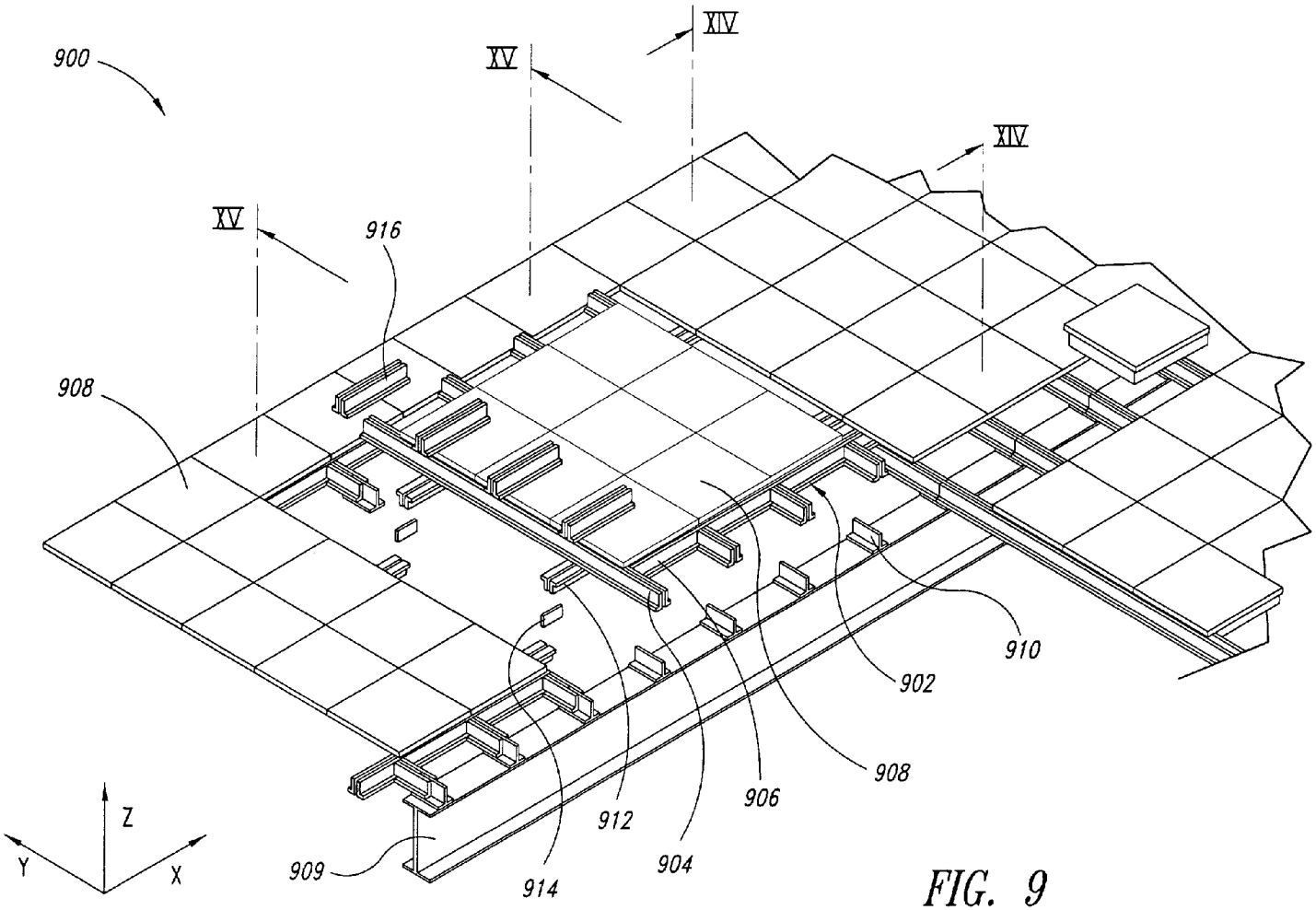
FIG. 9 is a partially exploded view of a flooring system according to another embodiment of the invention.

Another embodiment of the invention is described with reference to FIGS. 9-15. A floor system 900 is shown in FIG. 9 as part of a building structure. The system 900 includes a prefabricated floor section 902 having a first plurality of support rails 904. Each of the support rails 904 includes a pair of spaced-apart angle members running the full length of the section 902. Cross-support rails 906 are positioned at regular intervals between the support rails 904, each adjacent pair of support rails 904 and cross-support rails 906 forming an opening configured to receive a removable floor panel 908 therein.

Figure 10:
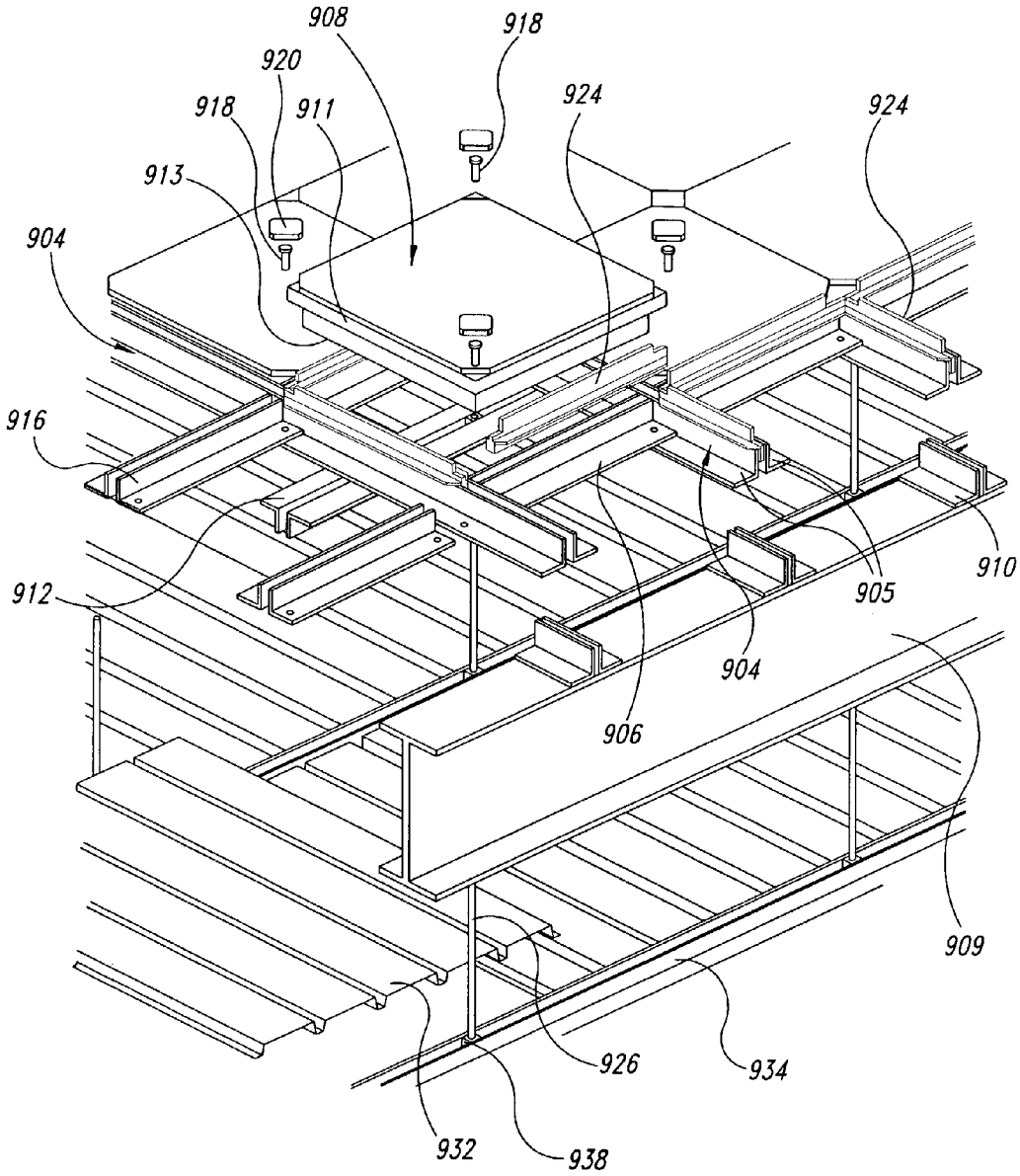
FIG. 10 is a more detailed view of the system of the embodiment of FIG. 9.

The prefabricated floor section 902 is configured to span secondary framing members 909 of the structure. Connectors 910 are affixed to an upper surface of the secondary framing members 909 in a regularly spaced relationship, corresponding to the spacing of the support rails 904 of the prefabricated section 902. The connectors 910 may be affixed to the upper surface of the secondary framing member 909 by any appropriate method, including welding, bolting, etc. FIG. 10 shows each connector 910 as comprising a pair of angle sections in a spaced-apart relationship. It will be understood that the connector 910 may be formed from a single T-shaped member or some other structure that provides the necessary spacing and support for the support rail 904. The spaced-apart angle members 905 of each support rail 904 engage the connector 910 to provide positive contact between the prefabricated section 902 and the secondary framing member 909. The support rails 904 may be affixed to the connectors 910 by a known method such as welding or bolting. Alternatively, some of the support rails 904 of the prefabricated section 902 may be affixed to their respective fasteners 910, while others of the support rails 904 may be allowed to rest directly on the connector 910 without being positively affixed thereto. The connectors 910 may be preaffixed to the secondary framing member 909 prior to erection of the structure. For example, the secondary support member 909 may have the connectors 910 affixed thereto at a fabricating plant prior to shipment to a construction site.

Figure 11:
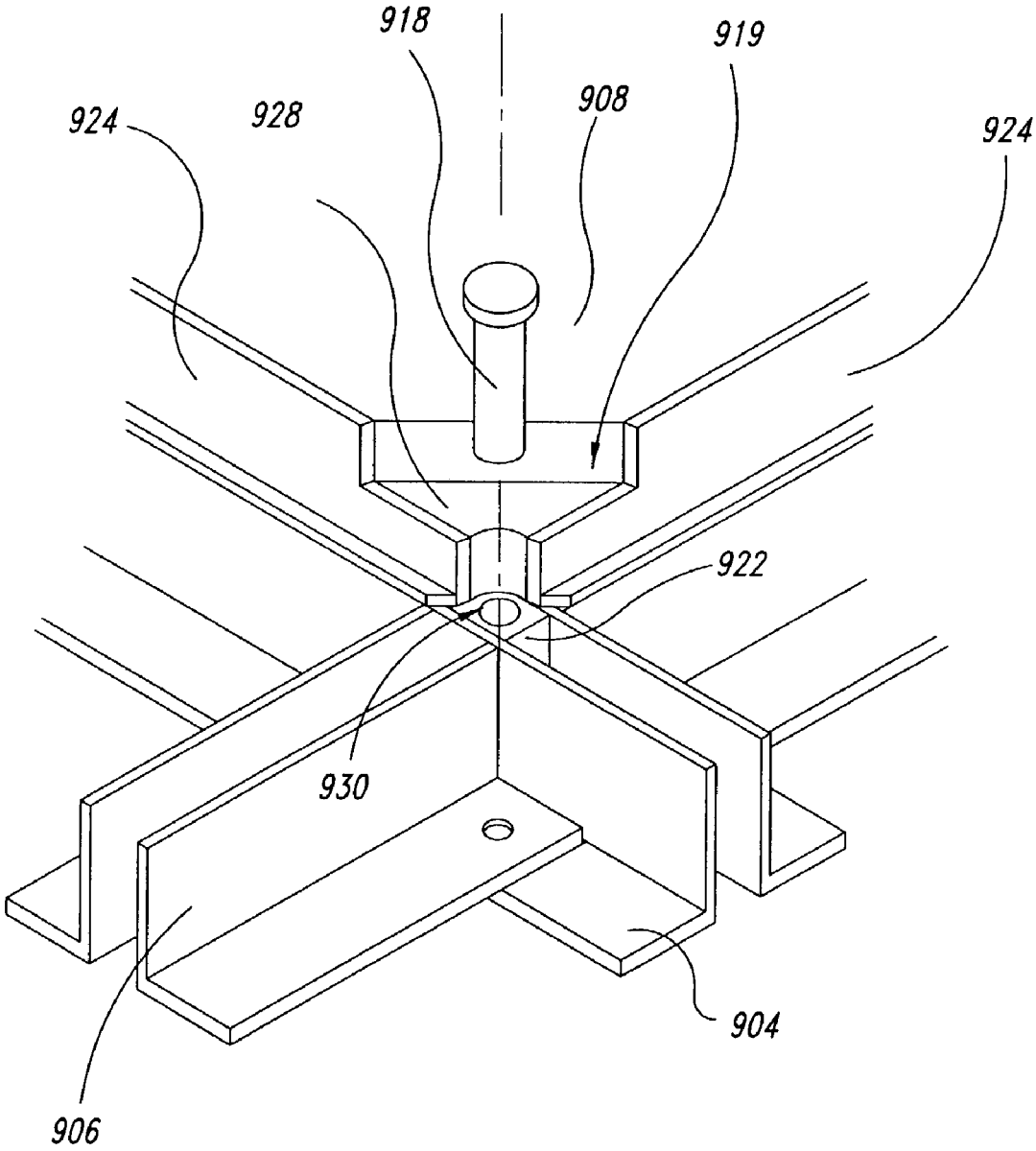
FIG. 11 shows a detailed view of a feature of the embodiment of FIG. 9.
Figure 12:
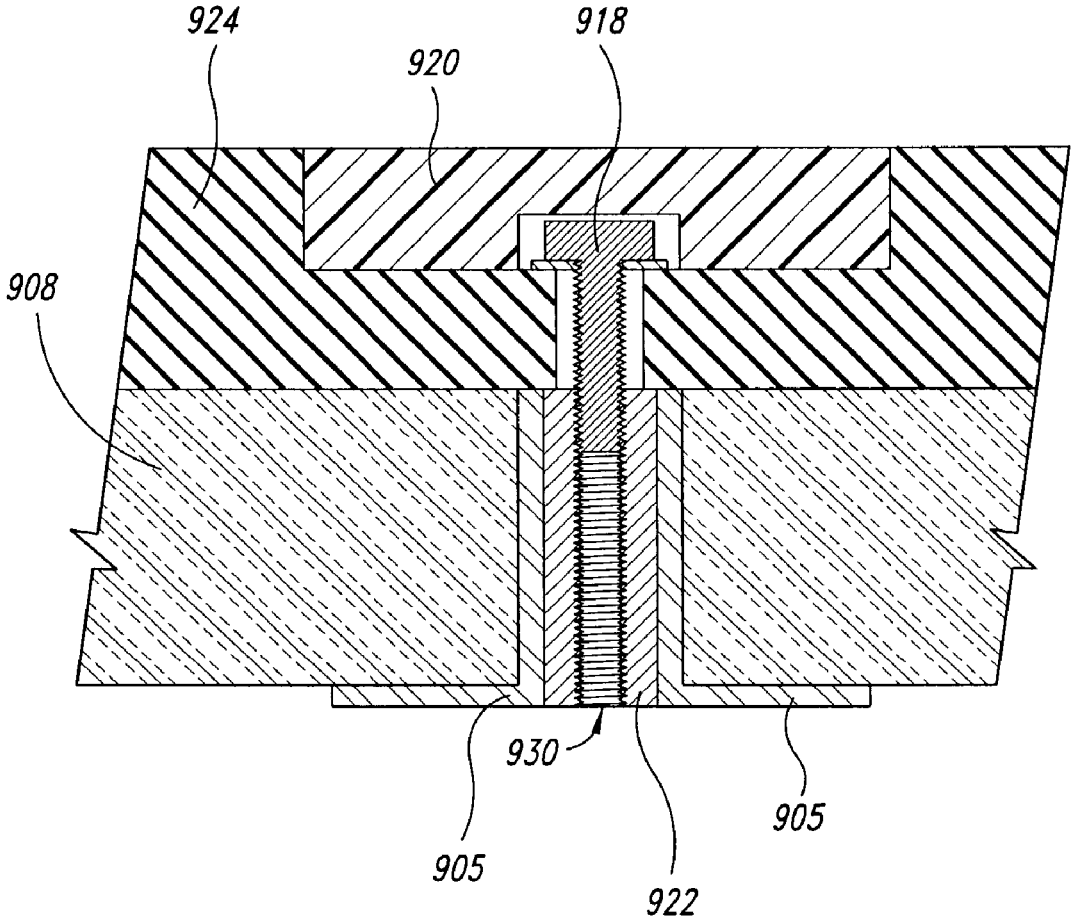
FIG. 12 is a cross sectional view of the portion of FIG. 10 indicated at lines XII-XII.
Figure 13:
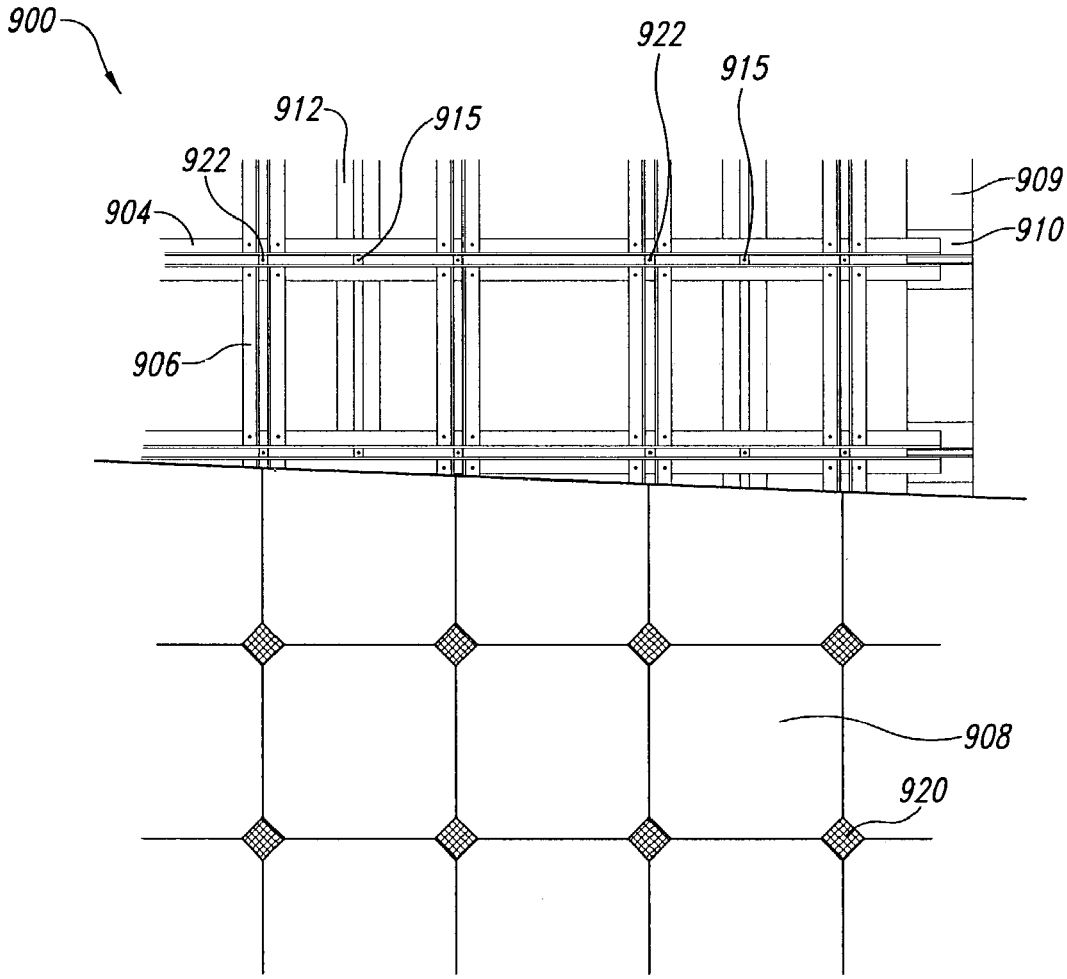
FIG. 13 is a partial cut-away plan view of the system of FIG. 9.

Spacers 922 are positioned and affixed between the spaced apart angle members 905 of each of the support rails 904. The spacers 922 maintain the spaced apart relationship of the angle members 905 in the embodiment shown, the spacer is illustrated as a section of square rod positioned between the angle members 905. FIGS. 10-12 show the spacers 922 having threaded holes passing therethrough, and positioned in locations corresponding to the positions of the crossrails 906.

The prefabricated section 902 includes subfloor rails 912 affixed to the underside of the prefabricated section 902 at right angles to the support rails 904. In the embodiment shown in FIGS. 9-15, the subfloor rails 912 comprise spaced-apart angle members 917 similar to those of the support rails 904, with square spacers 915 affixed between the angle members 917. The subfloor rails 912 run the entire width of the prefabricated section 902, and are positioned such, that the subfloor rails 912 of adjoining prefabricated sections 902 meet in an end-to-end configuration. Splice plates 914 affixed between subfloor rails 912 of adjoining sections 902 join the subfloor rails of adjoining sections 902 together. By aligning and joining subfloor rails 912 of adjacent sections 902 together, correct positioning and spacing of adjacent prefabricated sections 902 is assured. Secondary crossrails 916 are positioned in a spaced apart relationship between adjacent sections 902 in positions corresponding to the crossrails 906 of the prefabricated floor sections 902 to provide support for removable floor panels 908 to be placed between adjacent prefabricated panels 902.

Gaskets 924 of resilient or semi-resilient material are positioned between the floor panels 908. The gaskets 924 may be configured to improve the sound dampening characteristics of the floor system 900. The gaskets 924 may also be configured to provide a seal between adjacent floor panels 908, configured to prevent the passage of liquids or gasses therethrough. They may be formed from material that is heat or fire resistant, to provide improved fire protection. In FIG. 10, the gasket 924 may be seen to have a modified T-shape in cross-section, with a lower portion sized and configured to fit snugly between the spaced apart angle members 905 of the support rails 904, and the crossrails 906. The gaskets further include flanges extending to the sides and configured to receive the upper portions 911 of the floor panels 908 thereon. An upwardly extending portion of the gasket 924 rises between two adjacent floor panels 908 to terminate at a height approximately flush with an upper surface of the floor panels.

As disclosed in previous embodiments of the invention, the removable floor panel 908 includes an upper portion 911 having dimensions that are greater than a lower portion 913, such that, when a floor panel 908 is appropriately positioned between support rails 904 on two sides and crossrails 906 on two sides, the lower portion 913 of the panel 908 lies between the upright portions of the support rails 904 and crossrails 906, while the upper portion 911 of the panel 908 extends over the support rails 904 and crossrails 906. Typically, the floor panels 908 are configured to rest on the flanges of the gaskets 924, with the upper surface of the support and cross rails 904, 906 bearing the weight of the panels 908 and any load thereon. Such an arrangement ensures a good seal between the panel 908 and the flange 924. The lower portion 913 of the panels may comprise insulation and fire retardant material. The lower portion 913 of the floor panels 908 may be sized and configured to have a very snug fit in the space between the rails 904, 906 to provide maximum sound and temperature insulation and fire protection.

Other embodiments of the invention may include panels configured to bear against lower portions of the support and cross rails, or may even be configured to fit entirely between the support and cross rails, with no part of the panel extending over the rails.

As shown in FIGS. 10 through 12, the floor panels 908 may be affixed in position by threaded fasteners 918 that engage threads in the opening 930 of the spacer 922 of the support rails 904. The floor panel 908 includes a fastener recess 919 at each corner thereof. The fastener recess 919 defines a shoulder 928, against which a head of the threaded fastener 918 bears to maintain the floor panel 908 in position. A fastener 918 is provided at each corner of the floor panel 908, and each fastener 918 bears against the shoulders 928 of four adjoining removable panels 908. A fastener recess cap 920 is configured to fit in the fastener recesses 919 of four adjoining floor panels 908, and to cover the respective fastener 918.

Figure 14:
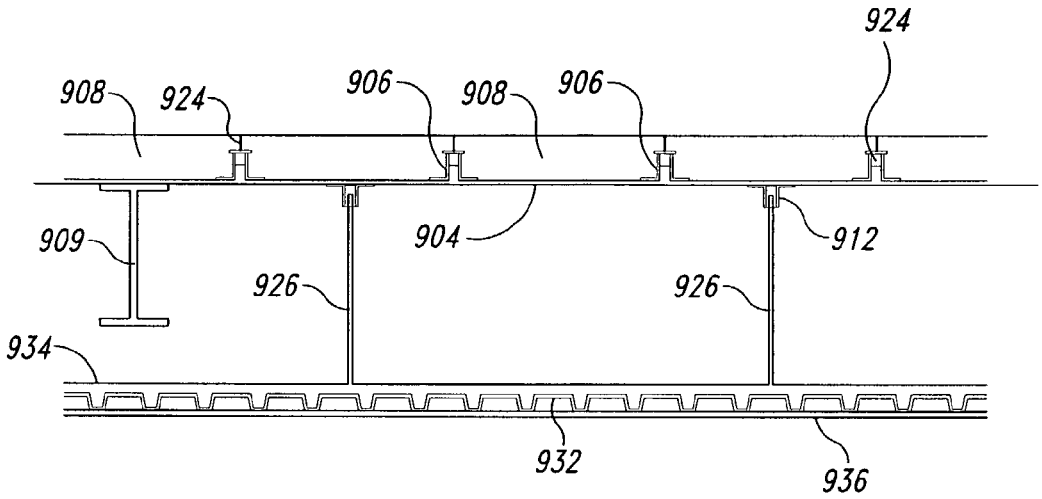
FIG. 14 is a cross sectional view of the portion of FIG. 9 indicated at lines XIV-XIV.
Figure 15:
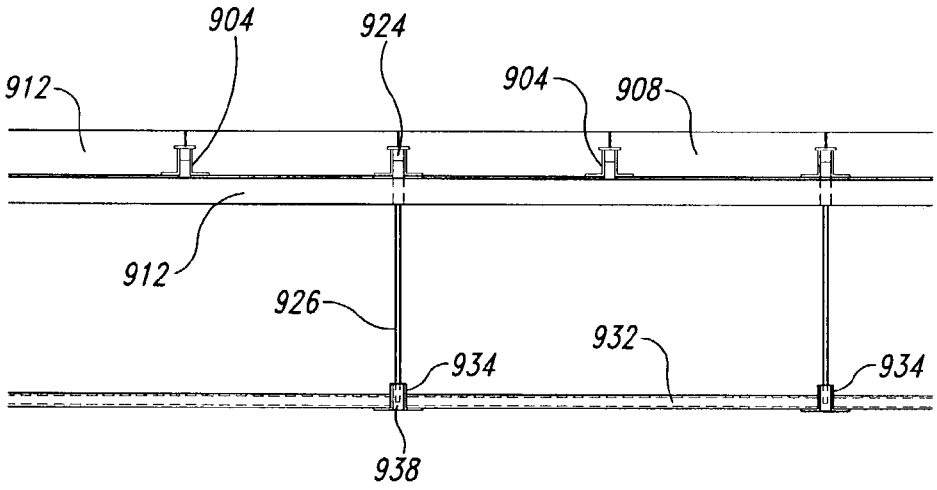
FIG. 15 is a cross sectional view of the portion of FIG. 9 indicated at lines XV-XV.

As is most easily visible in FIGS. 10, 14, and 15, the floor system 900 includes deck support rails 934, running generally parallel to the subfloor rails 912, and the secondary framing member 909. The deck support rails 934 include threaded spacers 938, similar to the spacers 922 of the support rails 904. Threaded rods 926 engage the threaded spacers 915 of the subfloor rails 912 at a first end and the threaded spacers 938 of the deck support rails 934 at a second end, supporting the deck support rails 934 a selected distance beneath the section 902. Corrugated decking 932, of a type commonly used in commercial construction to support concrete flooring, may be placed between deck support rails 934. The corrugated decking 932 provides a barrier between floors, and it may be used as part of a plenum enclosure for HVAC.

Lighting fixtures, fire control sprinklers, and other utilities for the space beneath the floor system 900 of FIGS. 9-15, such as a lower floor of the structure, may be affixed to the corrugated decking 932 or to the deck support rails 934. Fire resistant paneling such as gypsum board may also be affixed to the underside of the corrugated decking 936, or to the deck support rails 934.

In manufacturing and assembling the floor system 900, much of the system may be prefabricated and assembled prior to assembly in a structure. For example, the floor section 902 shown in FIG. 9 is an 8'×8' prefabricated section, having 2'×2' floor panels 908 installed therein. The prefabricated floor section 902 may include temporary removable panels 908, which can be left in place until completion of construction at which time the temporary panels 908 are replaced with finished panels. Use of temporary floor panels 908 prevents damage to the finished panels during construction, and allows construction workers, painters, and finishers to work in floored spaces without the requirement of providing protection for finished flooring. When the temporary panels are removed, they may be reused in subsequent projects, thus providing additional savings to the manufacturer.

In assembling such a floor system, the secondary framing members 909 are provided with the connectors 910 pre-attached. Each section is lifted into place by a hoist or crane, and lowered onto the connectors 910. Because of the configuration of the connectors 910 and the support rails 904, the floor section 902 is provided with positive positioning in the X-axis. As may be seen in FIG. 9, each connector 910 provides positioning for a support rail 904 from each of two adjoining panels 902 in an end-to-end configuration. By drawing the support rails 904 of a section 902 tightly against the ends of the support rails 904 of a previously installed section 902, positive positioning in the Y-axis may be assured. After the section 902 is correctly positioned in the X- and Y-axes, the section is leveled through the use of shims or jacks, to bring the section into correct position in the Z-axis. When the section is correctly positioned in the Z-axis, the support rails 904 of the section 902 are affixed to the connectors 910, to lock them permanently in position. This may be achieved by any of several known methods, including welding in place, the use of bolts passing through the support rails 904 and the connectors 910, or any other acceptable method of attachment. Next, splice plates 914 are affixed in position between subfloor rails 912 of adjoining sections 902, secondary crossrails 916 are then positioned and affixed to adjoining sections 902, and removable floor panels 908 are placed in the spaces created thereby, between adjoining sections 902. Threaded fasteners 918 and fastener recess caps 920 are installed as necessary to secure the removable floor panels 908. From underneath the floor panels 902, threaded rods 926 are affixed to the threaded spacers 915 of the subfloor rails 912, and to the threaded spacers 938 of the deck support rails 934. Corrugated decking 932 is then laid between the deck support rails 934 to enclose a space under the floor system 900.

The total height H of the floor system 900 (see FIG. 14) above the surface of the secondary framing members is selected to be approximately equal to the height or thickness of a conventional steel and concrete floor of the type commonly used in hi-rise construction. In some cases a structure may include a combination of conventional flooring with the structurally-integrated flooring according to the principles of the invention. Because the heights are substantially equal, there is no requirement for ramps or height adjustment at transitions from one flooring to the other.

It will be understood that, while the embodiment of the invention described with reference to FIGS. 9-15 is shown having particular selected dimensions, the dimensions of the sections 902, the spacing of the rails 904, 906, 912, 916, and 934, the dimensions of the panels 908, and other dimensions and parameters of the system are selectable according to the requirements of a given application, or preferences of the user.

In a conventional building, an elevated floor system of the type described in the background section of this document is installed on top of an existing floor. The elevated floor occupies a space above the floor, and is not part of the building structure. The accessible space provided by such an elevated floor is that space between the panels that form the surface of the elevated floor and the upper surface of the solid floor deck. In the structurally integrated accessible floor system of the embodiments of the invention described herein the solid floor deck is not needed. The removable panels provide access to the space beneath the grid and between the individual secondary framing members. In prior floor structures, this space is inaccessible and wasted. Because the structural support grid of the present invention spans the secondary framing members, the space beneath is unobstructed, providing simplified access for pulling cables, laying conduit, ducting, and pipe. The cost of the floor system disclosed herein is significantly mitigated by several factors. A conventional structural floor is not required, and the floor system is essentially the same height as a conventional structural floor, obviating the need for ramps in areas where conventional floors adjoin the floor system. Because the floor system does not add height per story to the final building structure, there will be a savings in building materials, and a savings in operating costs over those of a similar building using accessible floors according to the prior art. Also, because the space under the floor system is unencumbered by pedestals, feet, or other support devices, the floor system has improved flexibility and changeability. Pulling cable, laying conduit and pipe, and installing ducting are all simplified. The labor costs and down time costs are reduced during changeovers. This floor system would also allow the incorporation of, and relocation of, egress lighting in the floor system, as a part of the gasket systems, or the vertices of the panels, for example. The gaskets may also be configured to allow the passage of gas by incorporating perforations in the gaskets.

An additional cost savings over conventional construction methods is realized by the reduction in structural weight provided by the implementation of an embodiment of the invention. Flooring manufactured according to the principles of the invention has a per square foot weight of less than half that of conventional high-rise flooring. Such a weight savings can exceed 20 to 30 pounds per square foot, without reducing the weight bearing capacity of the floor. This savings translates to a reduction in the costs of bringing construction materials to a construction site, the costs of assembling a structure, the mass and cost of materials required to support a structure, and finally, affords the architect structural options that were heretofore unavailable due to the weight of the structure.

Advantages of the use of a sub floor space as a plenum for HVAC have been known previously. However, because of the inaccessibility of that space in conventionally constructed buildings, or the cost of conventional removable flooring systems, the associated effort and expense of employing sub floor spaces as plenums have outweighed the benefits, in most cases. With the implementation of the principles of the invention, the costs are much reduced. Sub floor spaces may be easily partitioned such that large areas of a floor may have pressurized, conditioned air, to be accessed as desired. Accordingly, ventilation may be inexpensively modified to suit varying needs and preferences, simply by exchanging floor panels with panels having the desired configuration. By the same token, return plenums having negative pressure may also be configured inexpensively. The need for expensive air ducting and channeling may be significantly reduced. All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A floor for a building having a plurality of primary structural building members lying in a first plane, comprising:

a plurality of spaced-apart secondary structural building members spanning the primary building members and lying in a second plane that is substantially parallel to the first plane;

a support grid spanning a distance between two of the plurality of secondary building members and bearing only on the two secondary building members, the support grid including intersecting structural members defining openings configured to receive panels, the distance spanned by the support grid exceeding a width or length of the openings; and a plurality of panels mounted on the support grid to form a section of a floor, each of the plurality of panels individually removable from the support grid to provide access to a space between the plurality of spaced-apart secondary structural building members.

2. The floor as claimed in claim 1, comprising means for fastening the plurality of panels individually to the support grid.

3. The floor as claimed in claim 1, comprising means for leveling the floor.

4. The floor as claimed in claim 3 wherein the leveling means comprises a plurality of structures individually interposed between each of the plurality of spaced apart secondary structural building members and the support grid, and individually adjustable to vary a distance between each of the plurality of spaced apart secondary structural building members and the support grid.

5. The floor as claimed in claim 1 wherein the plurality of panels comprises at least one panel configured to enable the passage of gas from a first side of the at least one panel to a second side of the at least one panel.

6. The floor as claimed in claim 5, comprising a partition in the space between the plurality of spaced apart secondary structural building members to subdivide a plenum formed by the floor.

7. The floor as claimed in claim 1, comprising a fire resistant barrier affixed to the bottom surfaces of the plurality of spaced apart secondary structural building members.

8. The floor as claimed in claim 1 wherein the plurality of panels are configured to dampen sound transmission.

9. The floor as claimed in claim 1 wherein a major axis of the support grid is oriented at about 90 degrees to a longitudinal axis of the plurality of spaced apart secondary structural building members.

10. The floor as claimed in claim 1 wherein a major axis of the support grid is oriented at about 45 degrees to a longitudinal axis of the plurality of spaced apart secondary structural building members.

11. The floor structure of claim 1 wherein the grid assembly further comprises:

a plurality of hanging structures, each coupled to one of the plurality of intersecting grid members; and a sub-floor deck coupled to the plurality of hanging structures and suspended thereby below the rigid grid assembly.

12. A floor system, comprising:

a prefabricated floor section, including:

a plurality of support rails positioned a selected distance apart, each having a pair of spaced apart angle members with spacers positioned between the angle members, the plurality of support rails configured to extend between two horizontal structural members of a building, and a plurality of cross rails, each spanning between adjacent pairs of support rails, the support rails and cross rails together defining a plurality of apertures between adjacent pairs of support rails and adjacent pairs of cross rails;

a plurality of connectors configured to be affixed to upper surfaces of the structural members of the building; each connector being further configured to be received between the pair of spaced apart angle members of at least one of the plurality of support rails, and wherein each of the plurality of support rails is configured to be affixed to respective pairs of connectors at selected heights above the respective structural members; and a plurality of removable floor panels, each positioned within one of the plurality of apertures.

13. The floor system as claimed in claim 12, further comprising a plurality of threaded fasteners, each configured to engage a threaded hole in one of the spacers positioned between the angle members and having a head configured to engage one or more of the plurality of removable floor panels.

14. The floor system as claimed in claim 12, further comprising:

a plurality of threaded rods, each configured to engage a threaded hole in one of the spacers positioned between the angle members and hang below the plurality of support rails; and a plurality of secondary support rails, each coupled to at least two of the plurality of threaded rods and configured to extend substantially parallel to a plane defined by the plurality of support rails.

15. The floor system as claimed in claim 14, further comprising a sub-floor deck coupled to the secondary support rails.

16. The floor system as claimed in claim 15 wherein sections of the sub-floor deck are configured to rest on flanges of adjacent ones of the plurality of secondary support rails.

17. The floor system as claimed in claim 15 wherein the sub-floor deck comprises a plurality of corrugated metal panels.

18. A pre-assembled floor section, comprising:

a plurality of support members positioned and rigidly coupled together to collectively define a plurality of openings sized to receive removable floor panels, the pre-assembled floor section configured to span between a plurality of horizontal building members;

means for coupling the pre-assembled floor section to an adjoining pre-assembled floor section;

a plurality of connectors coupled to respective ones of the plurality of support members for hanging a sub-floor deck below a level of the floor section, each connector having a threaded opening; and a plurality of threaded rods threadedly received in the threaded openings of respective ones of the plurality of connectors.

19. The floor section of claim 18 wherein each of the plurality of connectors is configured to receive fastening means for removably fastening a removable floor panel.

20. A floor for a building, comprising:

a plurality of sections configured to be separately pre-assembled prior to a final assembly of the floor, each of the plurality of sections having a support grid defined by first and second pluralities of support members lying in a plane, the first plurality of support members lying parallel to a first axis and the second plurality of support members lying parallel to a second axis, perpendicular to the first axis, the support grid configured to receive a plurality of removable floor panels in respective openings of the grid, the support grid further configured to be coupled to adjoining support grids, and to span between first and second horizontal framing members separated by a distance greater than a length or width of any one of the plurality of floor panels;

a plurality of fasteners, each coupled to a support grid of one of the plurality of sections;

a plurality of hanging structures, each coupled to a respective one of the plurality of fasteners;

a plurality of sub-floor deck support rails, each coupled to at least two of the plurality of hanging structures; and a sub-floor deck coupled to the plurality of sub-floor deck support rails.

21. The floor assembly of claim 20, further comprising means for leveling sections of the floor relative to a support structure thereof.

22. A floor system for supporting removable floor panels between two secondary structural members of a building, comprising:

a prefabricated floor section, including:

a plurality of support rails positioned a selected distance apart, the support rails configured to extend between the two secondary structural members of the building, each of the plurality of support rails including a pair of spaced apart angle members with spacers positioned between the angle members, a plurality of cross rails, each spanning between adjacent pairs of support rails and rigidly affixed thereto, the support rails and cross rails together defining a plurality of apertures between adjacent pairs of support rails and adjacent pairs of cross rails, each aperture configured to receive a removable floor panel; and a plurality of fasteners, each configured to be affixed to one of the secondary structural members, each of the plurality of fasteners coupled to an end of a respective one of the plurality of support rails.

23. The floor system as claimed in claim 22 wherein the floor section further includes a subfloor rail extending transverse to the support rails and affixed to a bottom side of each of the support rails.

* * * * *